US008082910B1

(12) United States Patent
Yehle

(10) Patent No.: US 8,082,910 B1
(45) Date of Patent: Dec. 27, 2011

(54) PULLEY ASSEMBLY FOR A COMPOUND ARCHERY BOW

(75) Inventor: Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 770 days.

(21) Appl. No.: 12/040,848

(22) Filed: Feb. 29, 2008

(51) Int. Cl.
*F41B 5/10* (2006.01)

(52) U.S. Cl. ..... 124/25.6; 124/23.1; 124/25; 124/86; 124/90

(58) Field of Classification Search ..... 124/23.1, 124/25, 25.6, 86, 90
See application file for complete search history.

(56) References Cited

U.S. PATENT DOCUMENTS 4,562,824 A * 1/1986 Jennings ..... 124/25.6
4,660,536 A * 4/1987 McPherson ..... 124/25.6
4,926,832 A * 5/1990 Darlington ..... 124/25.6
4,976,250 A * 12/1990 Jeffrey ..... 124/25
5,678,529 A * 10/1997 Larson ..... 124/25.6
5,782,229 A * 7/1998 Evans et al. ..... 124/25.6
5,960,778 A * 10/1999 Larson ..... 124/25.6
6,067,974 A * 5/2000 Islas ..... 124/25.6
6,082,347 A * 7/2000 Darlington ..... 124/25.6
6,155,243 A * 12/2000 Gallops, Jr. ..... 124/25
RE37,544 E * 2/2002 Darlington ..... 124/25.6
6,446,619 B1 * 9/2002 McPherson ..... 124/25.6
6,460,528 B1 * 10/2002 Gallops, Jr. ..... 124/25
6,474,324 B1 * 11/2002 Despart et al. ..... 124/25.6
6,516,790 B1 * 2/2003 Darlington ..... 124/25.6
6,575,153 B2 * 6/2003 Lommasson et al. ..... 124/25.6
6,718,963 B1 * 4/2004 Wheeler ..... 124/25.6
6,792,930 B1 * 9/2004 Kronengold et al. ..... 124/25.6
6,871,643 B2 * 3/2005 Cooper et al. ..... 124/25.6
6,966,312 B1 * 11/2005 Larson ..... 124/25.6
6,976,484 B1 * 12/2005 Gallops, Jr. ..... 124/25.6
6,990,970 B1 * 1/2006 Darlington ..... 124/25.6
7,082,937 B1 * 8/2006 Land ..... 124/25.6
7,305,979 B1 * 12/2007 Yehle ..... 124/25.6
7,311,098 B2 * 12/2007 Gallops, Jr. ..... 124/25.6
7,673,626 B1 * 3/2010 Hennings ..... 124/25.6
7,690,372 B2 * 4/2010 Cooper et al. ..... 124/25.6
7,770,568 B1 * 8/2010 Yehle ..... 124/25.6
2002/0144675 A1 * 10/2002 Lommasson et al. ..... 124/25.6
2004/0003806 A1 * 1/2004 Blahnik ..... 124/25.6
2004/0074485 A1 * 4/2004 Cooper et al. ..... 124/25.6
2005/0193998 A1 * 9/2005 Cooper et al. ..... 124/25.6
2005/0268892 A1 * 12/2005 Gallops, Jr. ..... 124/25.6
2006/0000463 A1 * 1/2006 Gallops, Jr. ..... 124/25.6
2009/0188482 A1 * 7/2009 Strother ..... 124/25.6
2010/0051005 A1 * 3/2010 Wilson ..... 124/25.6

* cited by examiner

*Primary Examiner* — Gene Kim
*Assistant Examiner* — Alexander Niconovich
(74) *Attorney, Agent, or Firm* — David S. Alavi

(57) ABSTRACT

A pulley assembly for a compound archery bow comprises a set of multiple power cable pulleys and a draw cable pulley. The draw cable pulley is arranged to be rotatably mounted on a bow limb, to let out the draw cable when the bow is drawn, and so as to have interchangeably mounted thereon any one of the multiple power cable pulleys. Each power cable pulley is arranged to take up the power cable when the bow is drawn. At least one of the power cable pulleys is arranged so as to result in substantially negligible let-off of draw force of the bow. At least one other of the power cable pulleys is arranged so as to result in substantial let-off of the draw force of the bow at a corresponding draw length.

23 Claims, 11 Drawing Sheets

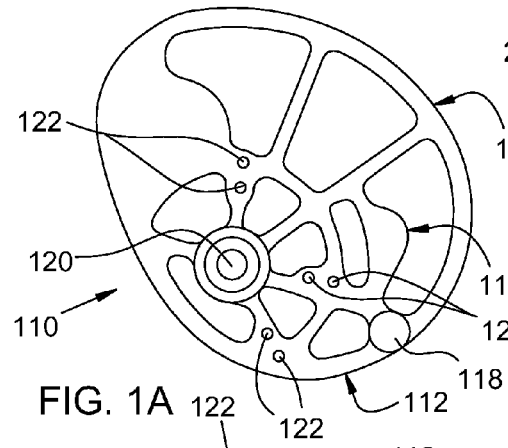
FIG. 1A
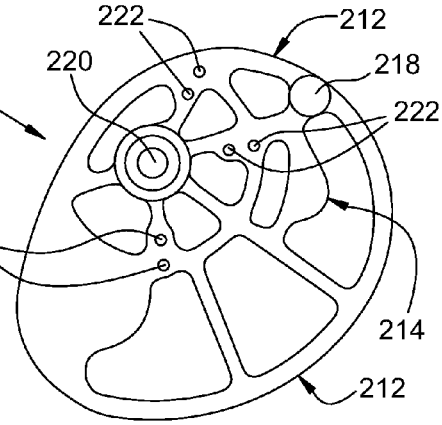
FIG. 2A
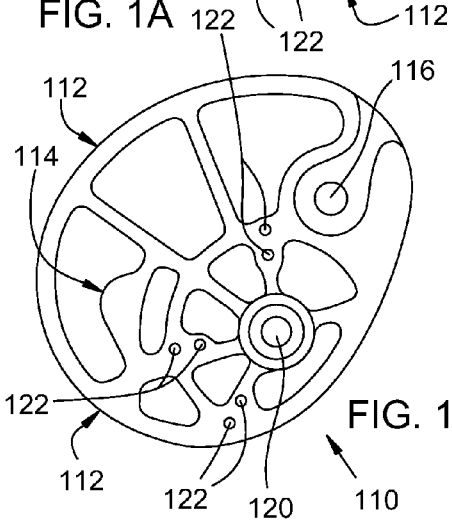
FIG. 1B
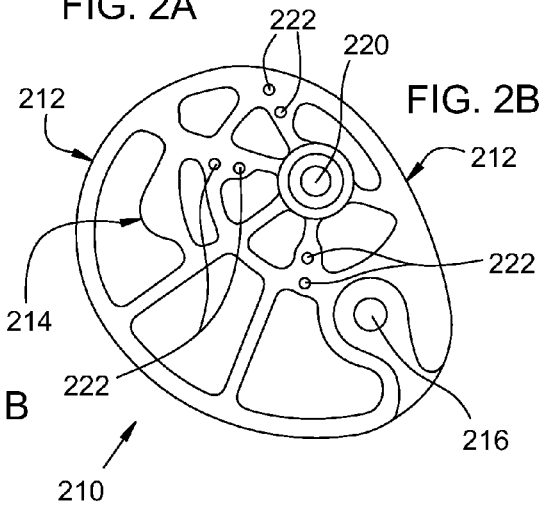
FIG. 2B
FIG. 1C
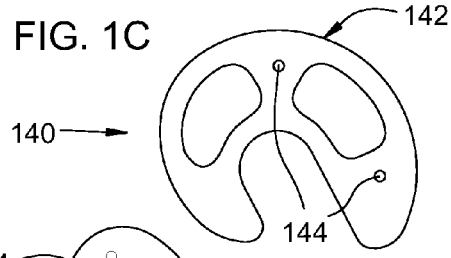
FIG. 2C
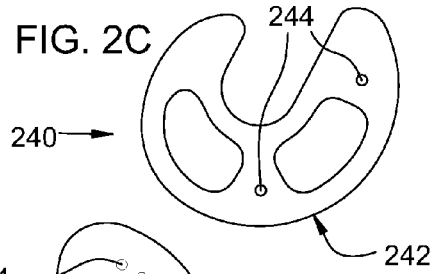
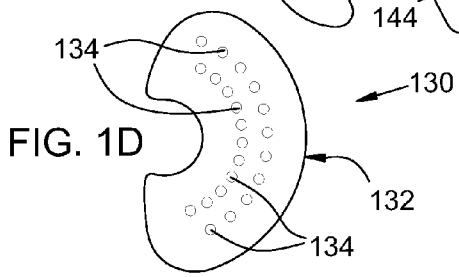
FIG. 1D
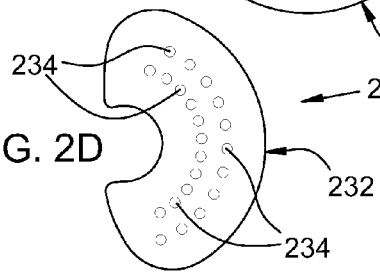
FIG. 2D

PULLEY ASSEMBLY FOR A COMPOUND ARCHERY BOW

BACKGROUND

The field of the present invention relates to a pulley assembly for a compound archery bow. In particular, a pulley assembly is disclosed herein having interchangeable power cable pulleys for providing substantial draw force let-off or for providing substantially negligible draw force let-off.

SUMMARY

A pulley assembly for a compound archery bow comprises a set of multiple power cable pulleys and a draw cable pulley. The draw cable pulley has a draw cable journal and each power cable pulley has a power cable journal. One of the power cable pulleys is mounted on the draw cable pulley. The draw cable pulley is arranged to be rotatably mounted on a limb of the bow, to receive the draw cable in the draw cable journal, and to let out the draw cable when the bow is drawn. The draw cable pulley is arranged so as to have interchangeably mounted thereon any one of the multiple power cable pulleys. Each power cable pulley is arranged to receive the power cable in the power cable journal and to take up the power cable when the bow is drawn. At least one of the power cable pulleys is arranged so as to result in substantially negligible let-off of draw force of the bow. At least one other of the power cable pulleys is arranged so as to result in substantial let-off of the draw force of the bow at a corresponding draw length.

Objects and advantages pertaining to a pulley assembly for a compound archery bow may become apparent upon referring to the exemplary embodiments illustrated in the drawings and disclosed in the following written description or appended claims.

BRIEF DESCRIPTION OF THE DRAWINGS

FIGS. 1A and 1B illustrate the two sides of an exemplary draw cable pulley for a lower pulley assembly for a compound archery bow. FIGS. 1C and 1D illustrate exemplary power cable pulleys for mounting on the draw cable pulley of FIGS. 1A and 1B.

FIGS. 2A and 2B illustrate the two sides of an exemplary draw cable pulley for an upper pulley assembly for a compound archery bow. FIGS. 2C and 2D illustrate exemplary power cable pulleys for mounting on the draw cable pulley of FIGS. 2A and 2B.

Figure 3:
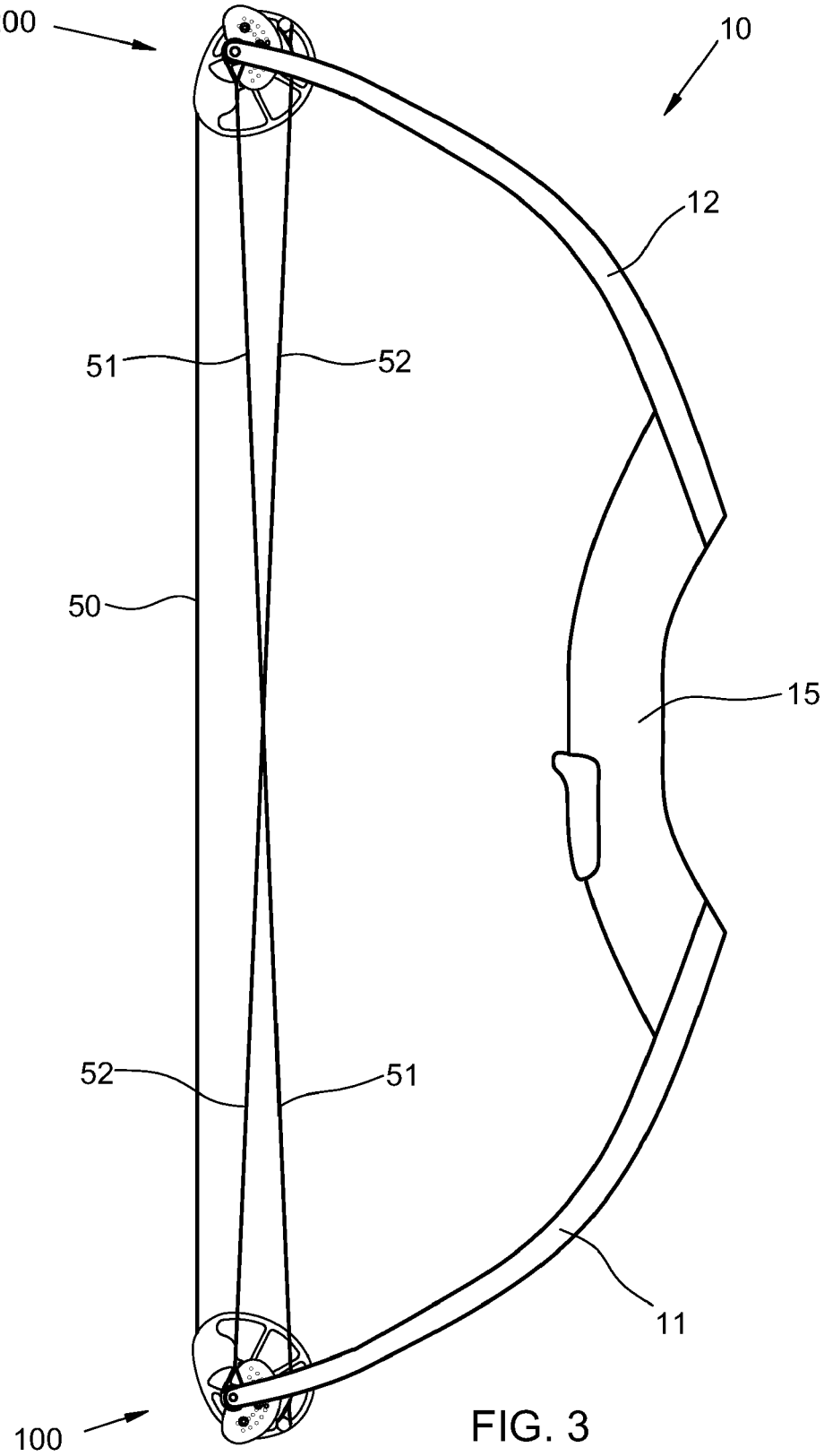
FIG. 3 illustrates an exemplary compound archery bow with upper and lower pulley assemblies arranged to result in substantial let-off of the draw force.

The embodiments shown in the Figures are exemplary, and should not be construed as limiting the scope of the present disclosure or appended claims.

DETAILED DESCRIPTION OF EMBODIMENTS

FIGS. 1A-1D illustrate components of an exemplary lower pulley assembly 100 for a compound archery bow. FIGS. 2A-2D illustrate components of an exemplary upper pulley assembly 200 for the bow. The description and arrangement of the upper and lower assemblies are analogous, and reference numbers for both are included in the following description. The lower (upper) pulley assembly 100 (200) comprises a draw cable pulley 110 (210) and a set of multiple power cable pulleys 130 (230) and 140 (240). The draw cable pulley 110 (210) includes a bearing or bushing 120 (220) for enabling the draw cable pulley to be rotatably mounted on a corresponding bow limb. Any suitable structure or arrangement can be employed for enabling such rotatable mounting. The draw cable pulley 110 (210) includes a draw cable journal 112 (212) in the form of a groove around at least a portion of its periphery to receive a draw cable and to let out the draw cable as the bow is drawn. The draw cable can be attached to the draw cable pulley 110 (210) at post 116 (216). Any suitable structure or arrangement of the draw cable pulley 110 (210) or its journal 112 (212) can be employed for securing the draw cable, receiving the draw cable, or letting it out as the bow is drawn (e.g., a series of posts on the draw cable pulley with the draw cable wrapped about them).

The draw cable pulley 110 (210) is arranged to have interchangeably mounted thereon either one of power cable pulleys 130 (230) or 140 (240). In the exemplary pulley assembly 100 (200), the power cable pulley is mounted using one or more of threaded holes 122 (222) on draw cable pulley 110 (210) and one or more of holes 134 (234) on power cable pulley 130 (230) or holes 144 (244) on power cable pulley 140 (240). Any suitable structure or arrangement can be employed for mounting a power cable pulley on the draw cable pulley. Either of power cable pulleys 130 (230) or 140 (240) includes a power cable journal 132 (232) or 142 (242), respectively, in the form of a groove around at least a portion of its periphery that is arranged to receive a power cable and to take up the power cable as the bow is drawn. The power cable can be attached to draw cable pulley 110 (210) at post 118 (218) and can be received in journal 114 (214) of the draw cable pulley 110 (210). Any other suitable structure or arrangement of the power cable pulley 130 (230) or 140 (240), its journal 132 (232) or 142 (242), or the pulley assembly 100 (200) can be employed for securing the power cable, receiving the power cable, or taking up the power cable as the bow is drawn.

An exemplary compound archery bow 10 is shown in FIG. 3 and includes a central handle portion or riser 15 and lower and upper bow limbs 11 and 12, respectively. Lower pulley assembly 100 is shown rotatably mounted on lower bow limb 11 and upper pulley assembly 200 is shown rotatably mounted on bow limb 12. The arrangement of the bow 10 is exemplary; any suitable arrangement of bow 10 can be employed. In the example of FIG. 3, lower pulley assembly 100 comprises draw cable pulley 110 and power cable pulley 130, and upper pulley assembly 200 comprises draw cable pulley 210 and power cable pulley 230. Power cable pulleys 130 and 230 form a corresponding pair, and are arranged so that bow 10 exhibits a substantial let-off of draw force at a corresponding draw length. Draw cable 50 is received by draw cable pulleys 110 and 210; power cable 51 is attached to draw cable pulley 110, received by power cable pulley 130, and attached to bow limb 12; power cable 52 is attached to draw cable pulley 210, received by power cable pulley 230, and attached to bow limb 11.

Figures 4A, 4B:
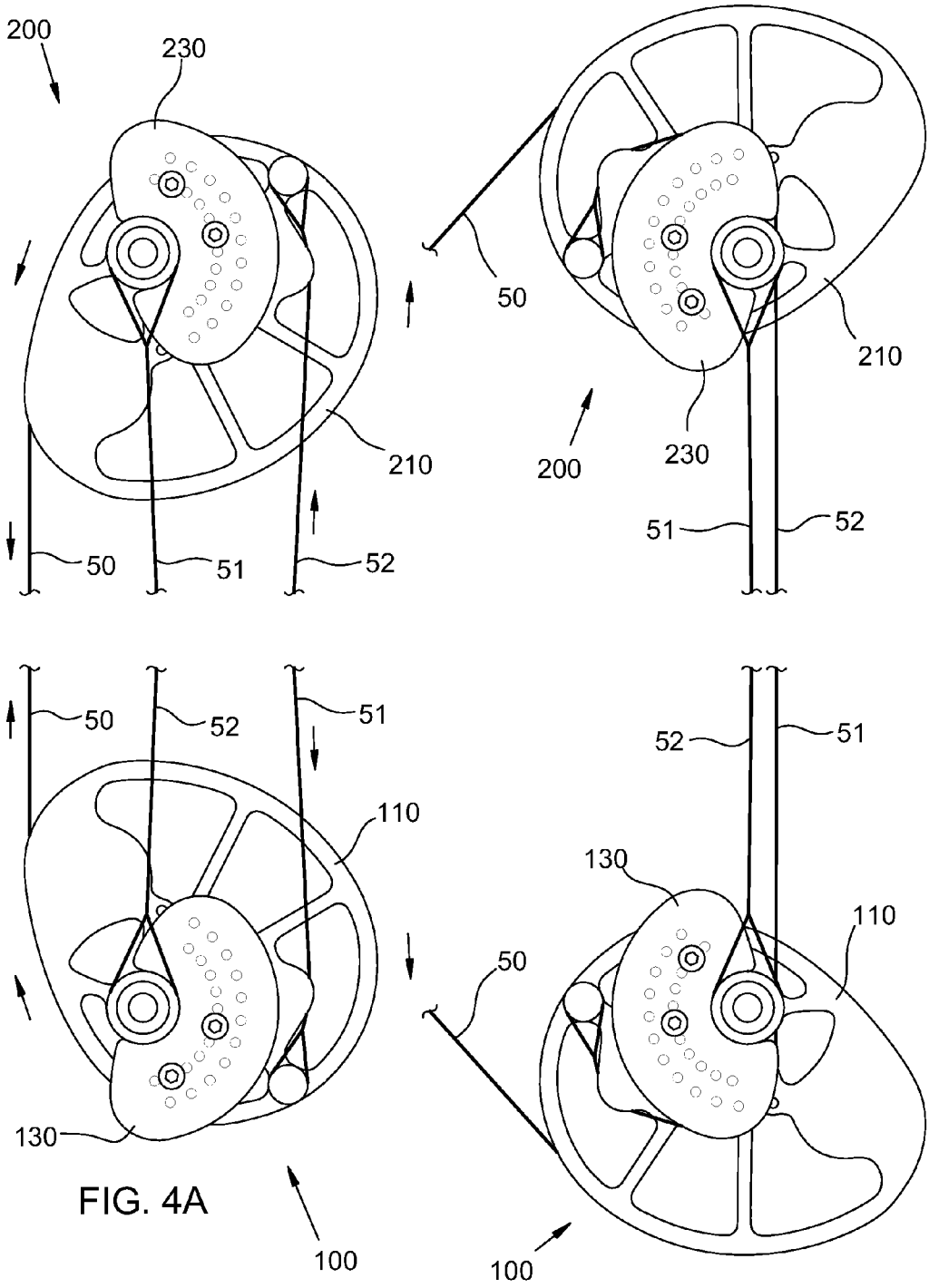
FIGS. 4A and 4B illustrate exemplary upper and lower pulley assemblies at brace and at let-off of the draw force, respectively.
Figures 5A, 5B:
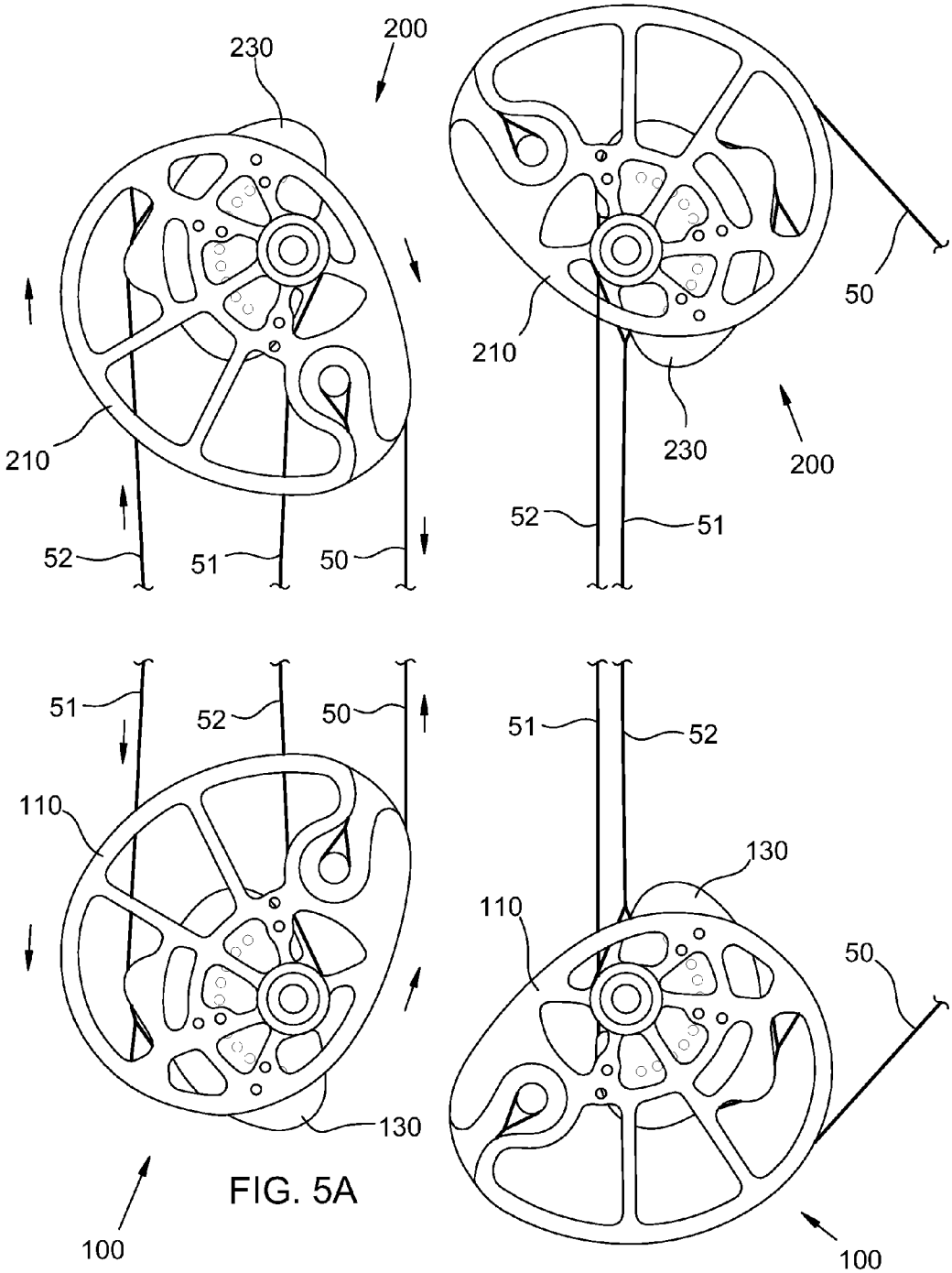
FIGS. 5A and 5B illustrate the exemplary upper and lower pulley assemblies of FIGS. 4A and 4B from the opposite side.

The arrangement of pulley assemblies 100 and 200 are shown in more detail in FIGS. 4A and 5A (before the bow is drawn, i.e., "at brace") and in FIGS. 4B and 5B (at let-off of the draw force, i.e., "at the draw length" for a bow having let-off of the draw force). The arrows indicate the direction of movement of the cables and the direction of rotation of the pulley assemblies as the bow is drawn. The power cable pulley 130 (230) is arranged so that at the draw length, the lever arm of the power cable pulley abruptly drops, resulting in reduction (i.e., let-off) of the draw force. In the arrangement of FIGS. 4A, 4B, 5A, and 5B, the pulley assemblies 100 and 200 each rotate through about 150° to 160° before reaching let-off of the draw force. The actual draw length depends on this angle, the average radius of the draw cable pulley, and the overall geometry of the bow.

Figure 6A:
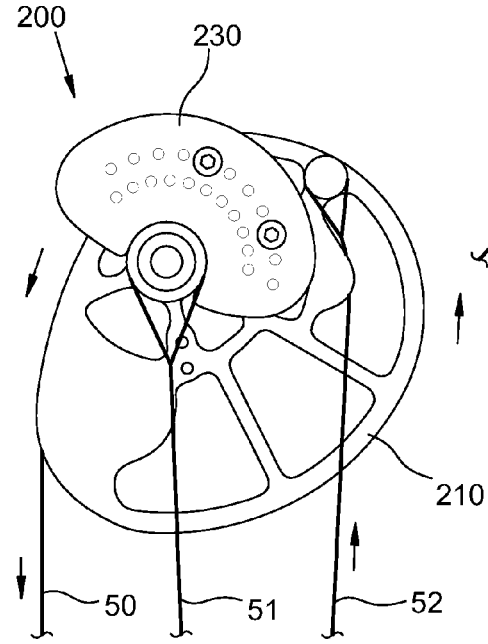
FIGS. 6A and 6B illustrate exemplary upper and lower pulley assemblies at brace and at let-off of the draw force, respectively.
Figure 6A:
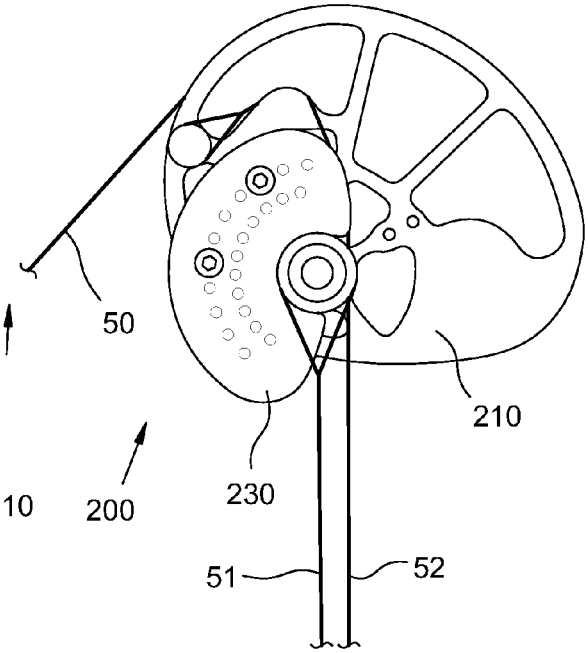
Figure 6A:
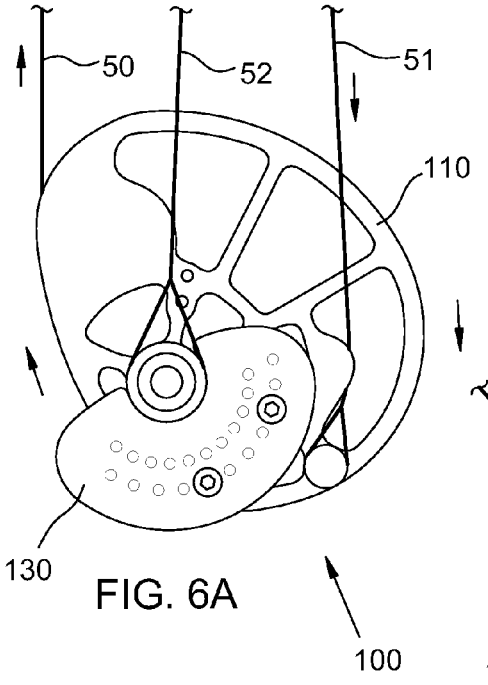
Figure 6B:
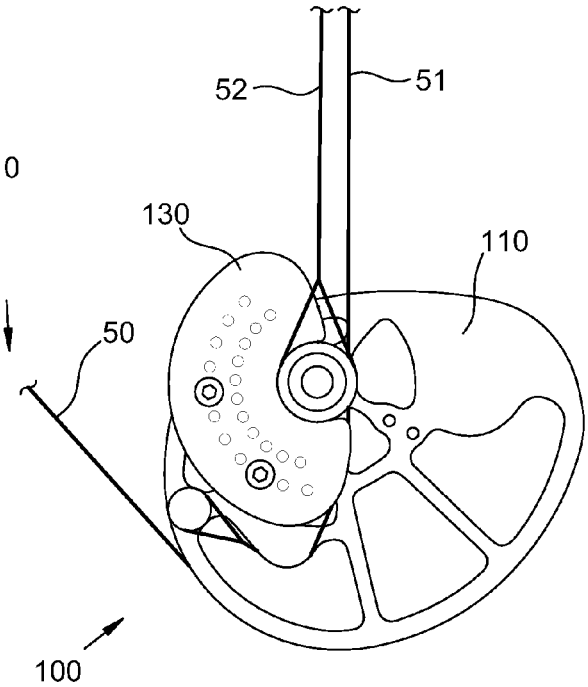
Figure 7A:
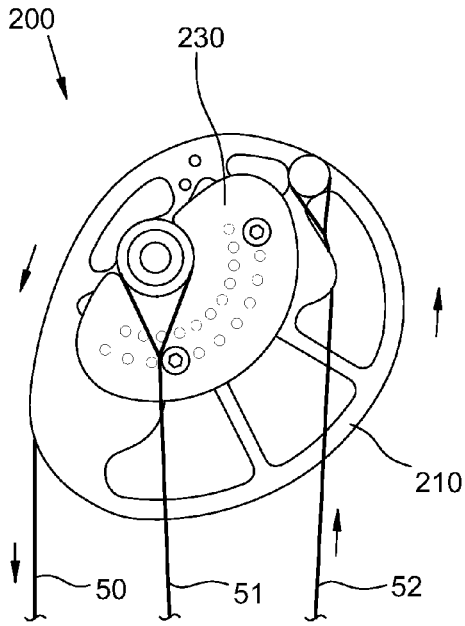
FIGS. 7A and 7B illustrate exemplary upper and lower pulley assemblies at brace and at let-off of the draw force, respectively.
Figure 7A:
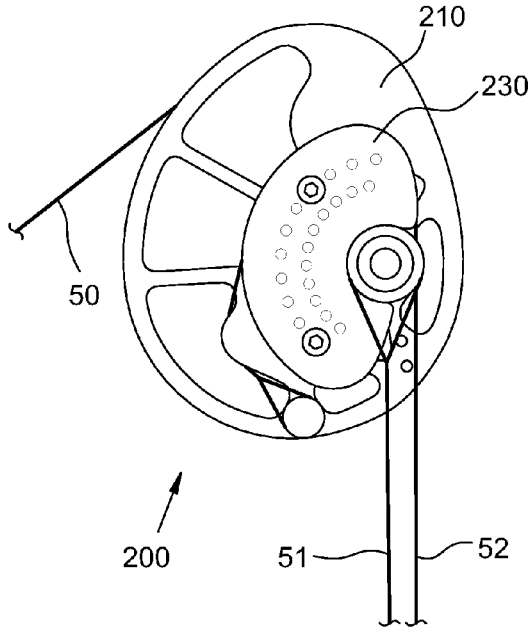
Figure 7A:
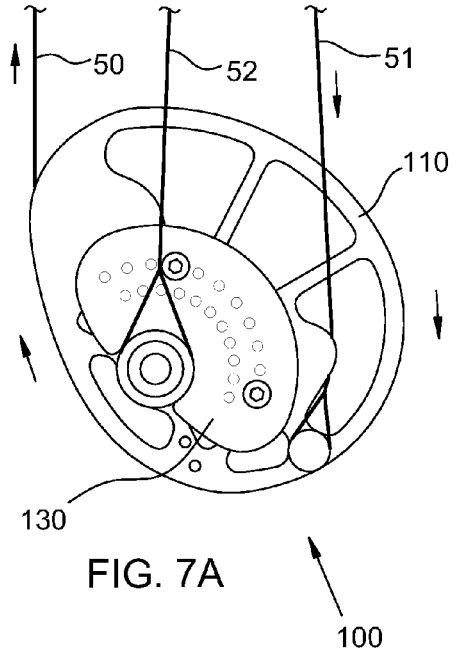
Figure 7B:
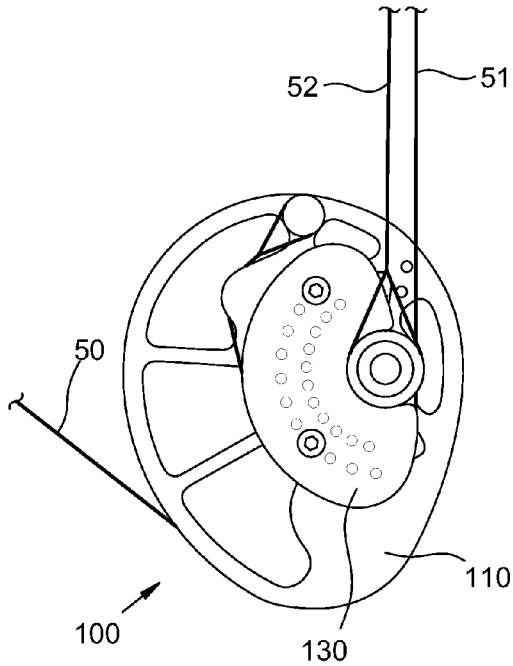

In this example, the power cable pulley 130 (230) is arranged, by means of multiple holes 134 (234) to be secured to the draw cable pulley in differing positions. The relative position of the power cable and draw cable pulleys can be altered to in turn alter the draw length of the bow. For example, in FIGS. 6A and 6B, the power cable pulley 130 (230) has been mounted on draw cable pulley 110 (210) so that let-off of the draw force is reached at about 100° to 110° of rotation, resulting in a correspondingly reduced draw length for the bow. In the example of FIGS. 7A and 7B, power cable pulley 130 (230) is mounted on draw cable pulley 110 (210) so that let-off of the draw force is reached at about 210° to 220° or rotation, resulting in a correspondingly increased draw length for the bow. Differing draw lengths can be advantageously employed for archers of differing reach, arm span, or stature.

Instead of using a single power cable pulley 130 (230) that can be mounted in differing locations on draw cable pulley 110 (210) to achieve differing draw lengths, multiple, interchangeable, differing power cable pulleys 130 (230) can be employed instead, with each differing power cable pulley providing a different draw length for the bow.

Figure 8:
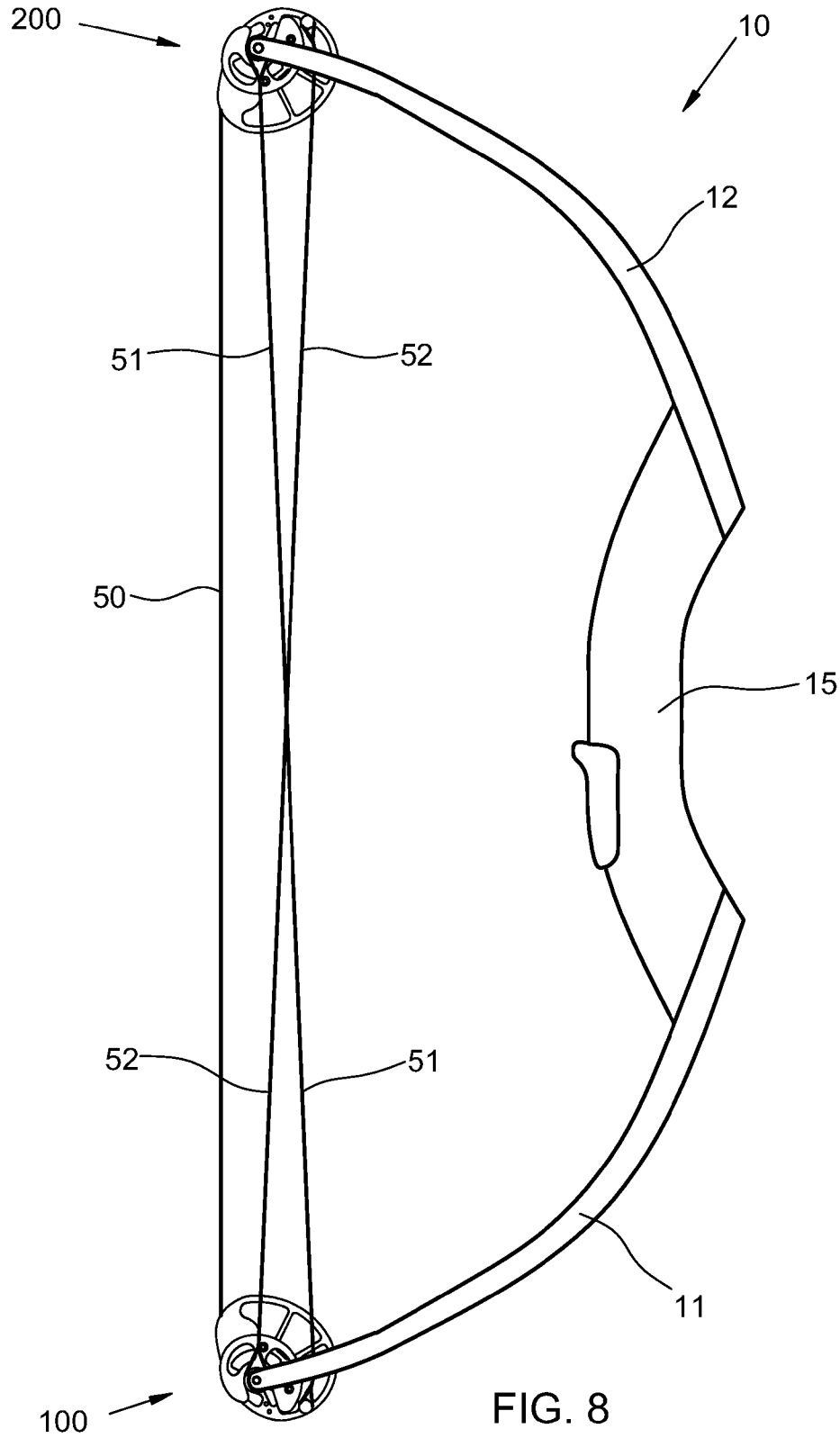
FIG. 8 illustrates an exemplary compound archery bow with upper and lower pulley assemblies arranged to result in substantially negligible let-off of the draw force.

An exemplary compound archery bow 10 is shown in FIG. 8 that is similar to that shown in FIG. 3, except that power cable pulleys 140 and 240 are mounted on draw cable pulleys 110 and 210, respectively, instead of power cable pulleys 130 and 230. Power cable pulleys 140 and 240 form a corresponding pair, and are arranged so that bow 10 exhibits a substantially negligible let-off of draw force as the bow is drawn. The corresponding arrangement of pulley assemblies 100 and 200 are shown in more detail in FIGS. 9A and 10A (at brace) and in FIGS. 9B and 10B (drawn). The power cable pulley 140 (240) is arranged so that the lever arm of the power cable pulley remains fairly constant as the bow is drawn (or decreases only in a manner commensurate with an increasing force required to bend the bow limbs), resulting in substantially negligible let-off of the draw force as the bow is drawn. Such an arrangement may be advantageously employed, for example, when multiple archers of varying reach, arm span, or stature share the same bow during a given session (e.g., in a class or lesson setting). A shared bow having let-off at a draw length suitable for one archer might be awkward, difficult, or even impossible for another archer to use. By eliminating the let-off of the drawn force, the bow can be used with equal ease by all archers. In the example shown, the power cable pulley lever arm remains fairly constant for rotation of the pulley assembly through over 180°.

The arrangement disclosed herein provides the new and useful result of a compound archery bow that can be readily converted between a configuration having a substantial draw force let-off at a given draw length (adjustable or not, as desired) and a configuration having no substantial draw force let-off (therefore readily usable over a substantially wider range of draw distances).

Figure 11A:
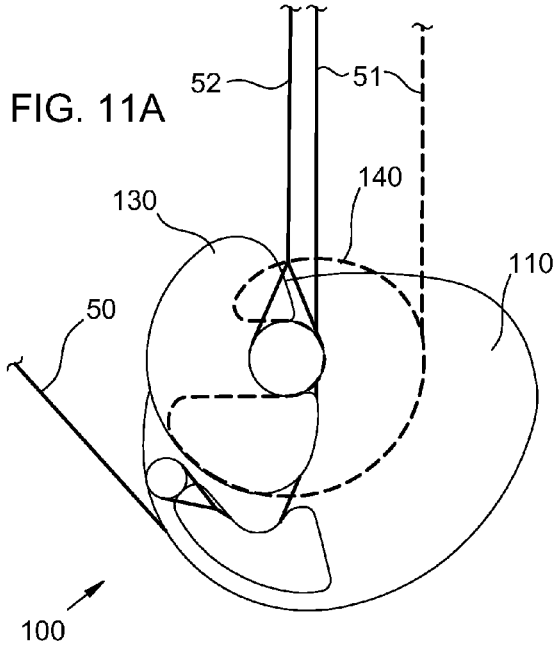
FIGS. 11A-11C illustrate schematically various exemplary arrangements of a pulley assembly with interchangeable power cable pulleys mounted on a draw cable pulley.
Figure 11B:
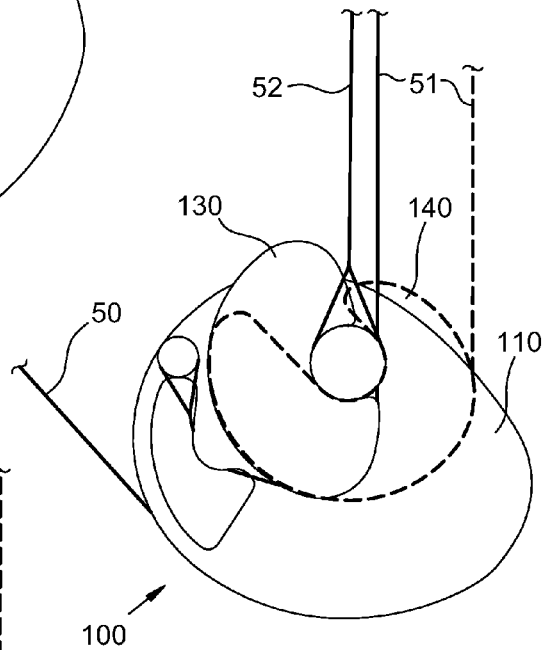
Figure 11C:
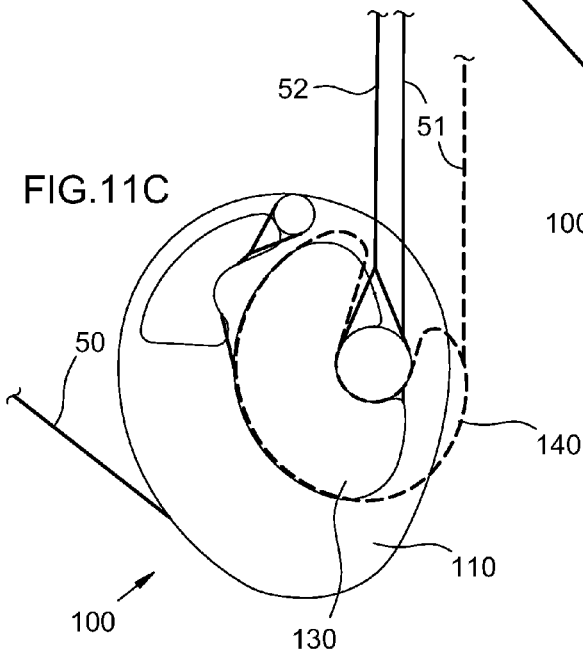
Figure 12:
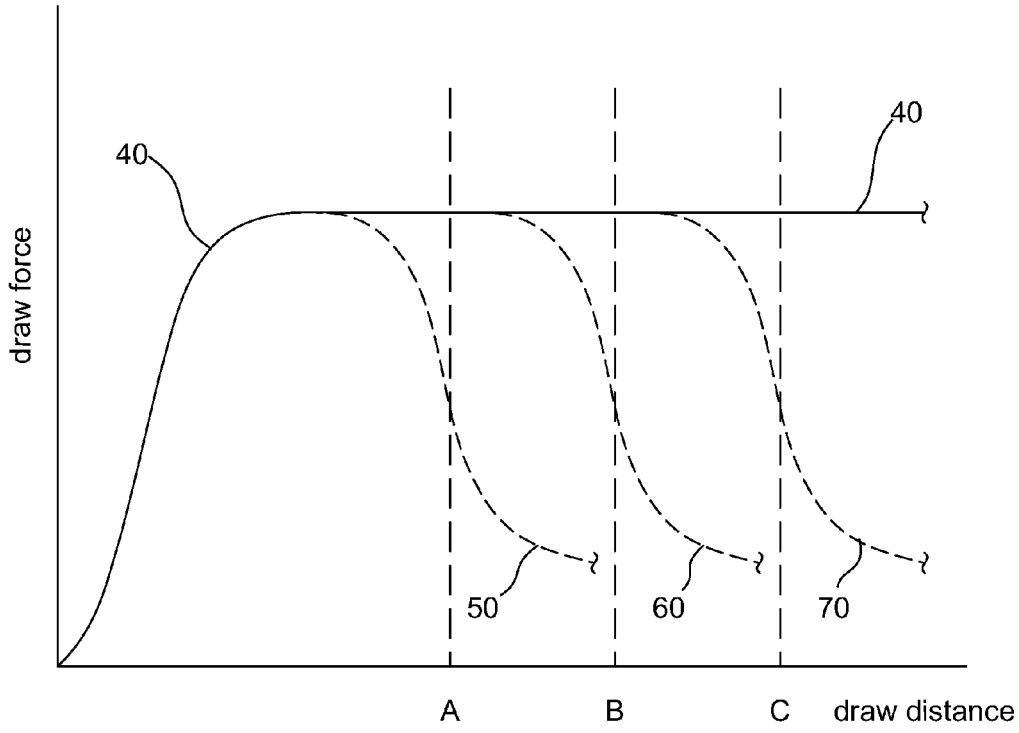
FIG. 12 illustrates schematically exemplary draw force versus draw distance curves for differing arrangements of a pulley assembly with interchangeable power cable pulleys mounted on a draw cable pulley.

If needed or desired, power pulleys 130 (230) and 140 (240) can be arranged so that the draw force before let-off using pulley 130 (230) and is the same as the draw force using pulley 140 (240). This is illustrated schematically in FIGS. 11A-11C and graphically in FIG. 12. The respective journals of the power pulleys 130 and 140 substantially coincide up to the point where the draw force lets off with pulley 130, after which the lever arm of pulley 130 abruptly decreases. Graph 40 of FIG. 12 is a schematic representation of the draw force versus draw distance using power cable pulley 140 (240), or using power cable pulley 130 (230) before let-off. Graph 50 shows let-off at draw length A (corresponding to FIGS. 6A and 6B, for example), Graph 60 shows let-off at draw length B (corresponding to FIGS. 4A and 4B, for example), and Graph 70 shows let-off at draw length C (corresponding to FIGS. 7A and 7B, for example). The draw distances and draw force curves should be regarded only as qualitative indicators.

While the foregoing examples illustrate arrangements wherein the draw force versus draw distance is the same prior to let-off regardless of which power cable pulley is used, this need not be the case. Any set of interchangeably mounted power cable pulleys can be employed, resulting in any corresponding draw force versus draw distance curves.

Figures 9A, 9B:
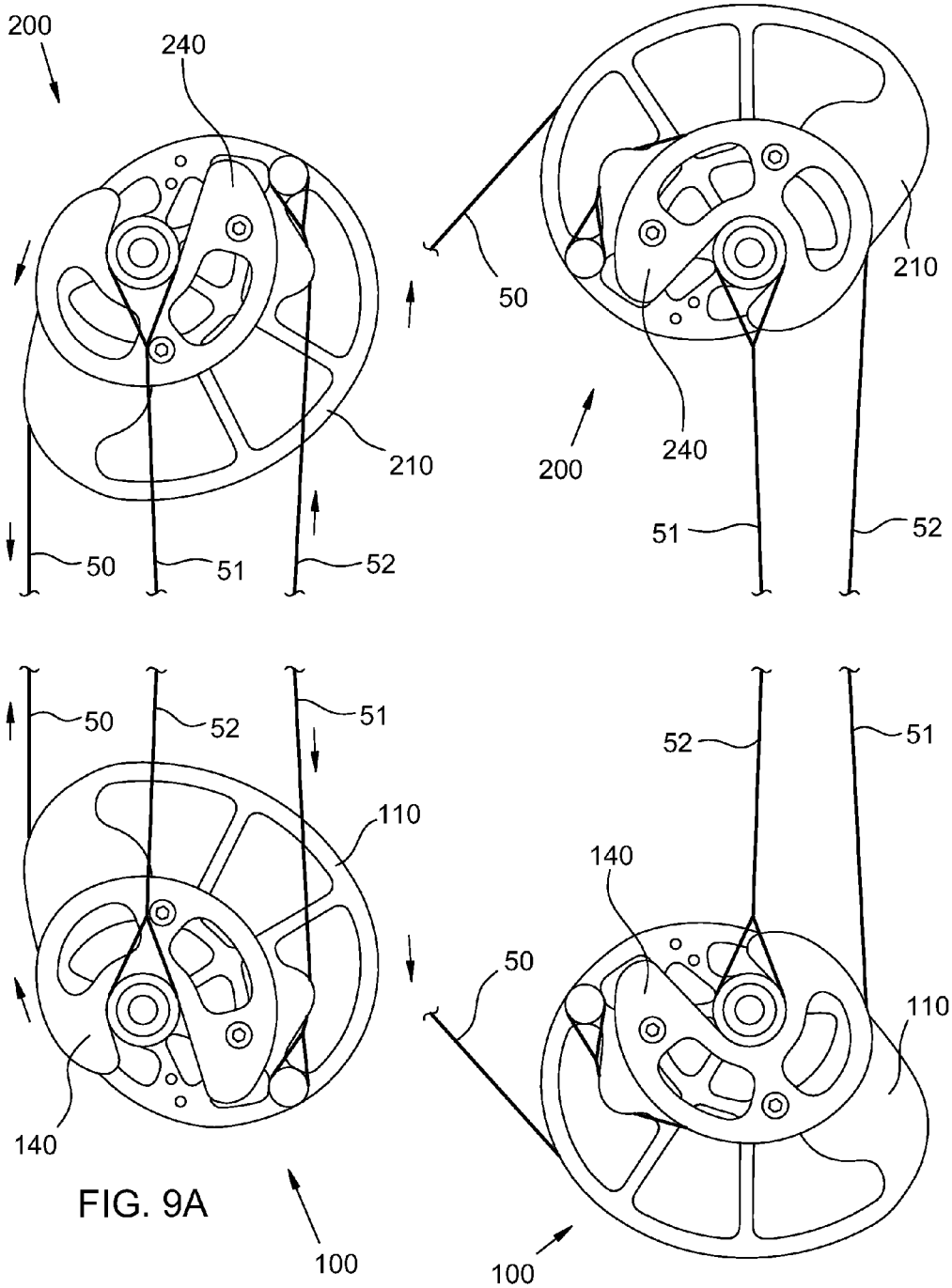
FIGS. 9A and 9B illustrate exemplary upper and lower pulley assemblies, at brace and drawn, respectively, that are arranged to result in substantially negligible let-off of the draw force.
Figure 10A:
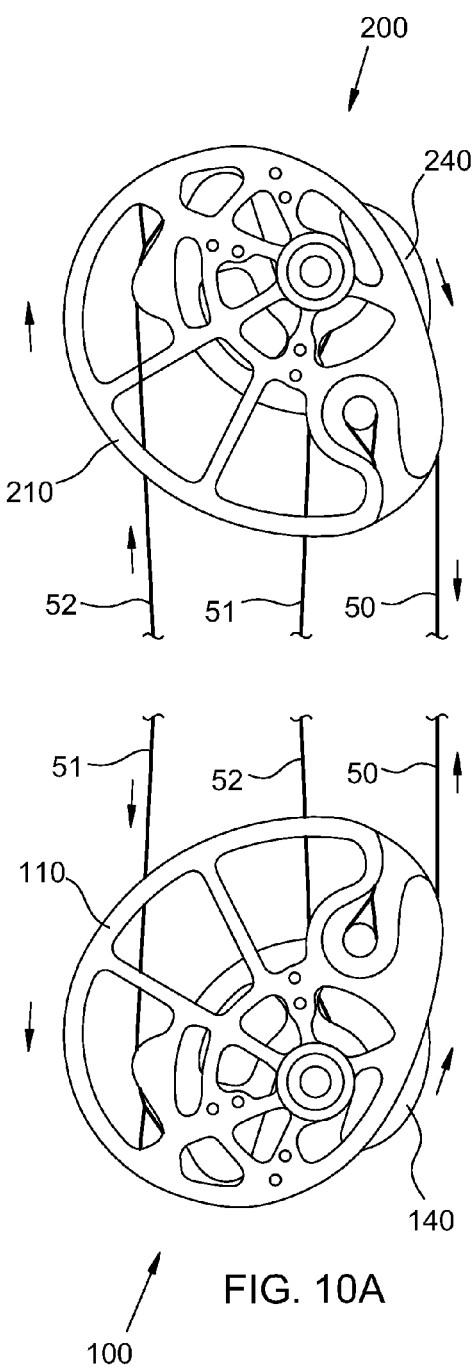
FIGS. 10A and 10B illustrate the exemplary upper and lower pulley assemblies of FIGS. 9A and 9B from the opposite side.
Figure 10B:
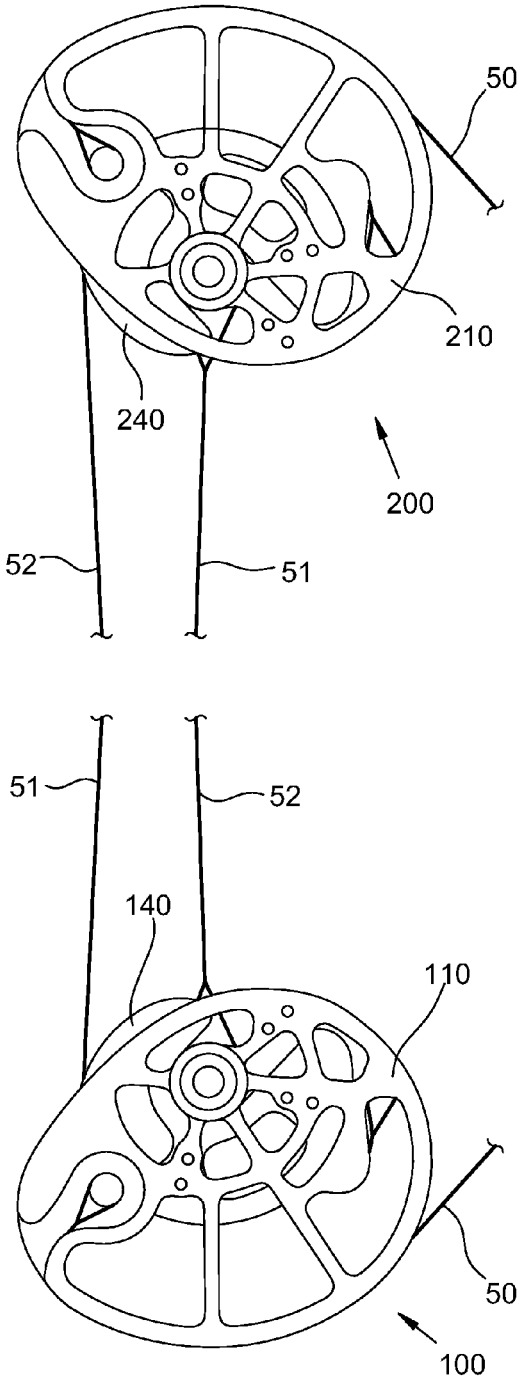

In FIGS. 4A, 6A, 7A, and 9A, it can be seen that at brace, power cable 51 (52) is not yet received in journal 132 (232) of power cable pulley 130 (230) (FIGS. 4A, 6A, and 7A), or in journal 142 (242) of power cable pulley 140 (240) (FIG. 9A). In each of these examples, the power cable is engaged at brace with journal 114 (214) of draw cable pulley 110 (210). This engagement enables adjustment, movement, mounting, or removal of power cable pulley 130 (230) or 140 (240) with requiring removal of any of the cables from the pulley assemblies 100 or 200. With such an arrangement, the compound bow can be adjusted to vary its draw length, or converted from having let-off at a particular draw length to having no let-off (or vice versa), all without removing any cables or otherwise disassembling the bow. While advantageous, such an arrangement is not required, and any suitable arrangement can be employed whether or not removal of one or more cables or disassembly of the bow is required.

The exemplary compound archery bows shown and described thus far have been dual cam bows, wherein the upper and lower pulley assemblies are substantial mirror images of each other, and each power cable is coupled at one end to a corresponding bow limb by being secured directly to that limb (with the other end being received in the corresponding power cable journal). However, neither the scope of the present disclosure nor that of the appended claims shall be construed as being limited to such bows. In one example, a dual cam bow having upper and lower pulley assemblies that differ from one another can be employed. In another example, a dual cam bow can be employed wherein the upper and lower pulley assemblies each include a power cable let-out journal as disclosed in U.S. Pat. No. 7,305,979, which is incorporated by reference as if fully disclosed herein. In such a bow, a power cable is coupled at one end to a corresponding bow limb by being received in a power cable let-out journal of the corresponding power cable let-out pulley. When the bow is drawn, each power cable is let-out at one end by the power cable let-out pulley of one pulley assembly, while it is taken up at its other end by the power cable pulley mounted on the other pulley assembly. The pulley assemblies of such bows are sometimes referred to as binary cams. In another example, a single- or solo-cam bow can be employed, wherein one pulley assembly comprises an idler wheel and the other pulley assembly includes a draw cable let-out pulley mounted on the draw cable pulley along with the power cable pulley (as in U.S. Pat. No. 5,368,006, for example, which is incorporated by reference as if fully disclosed herein). The draw cable passes around the idler wheel, with one end received in the draw cable journal of the draw cable pulley and the other end received in a draw cable let-out journal of the draw cable let-out pulley. When the bow is drawn, one end of the draw cable is let out from the draw cable pulley while the other end of the draw cable is let-out by the draw cable let-out pulley. These examples, and any other suitable arrangements, shall fall within the scope of the present disclosure or appended claims.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims. It should be noted that the draw cable pulleys and power cable pulleys referred to herein are sometimes also referred to as wheels or cams. Any such alternative terminology shall be construed as falling within the scope of the present disclosure or appended claims. Such pulleys, cams, or wheels can assume a circular, elliptical, oval, or other suitable or desirable shape, and can be mounted to rotate concentrically or eccentrically, as needed or desired. Non-circular shape or eccentric mounting can be employed to yield a pulley lever arm that varies as the pulley rotates.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

What is claimed is:

1. A compound archery bow, comprising:

a central handle portion;

a first flexible bow limb and a second flexible bow limb, the first and second bow limbs being mounted on the handle and projecting oppositely and substantially symmetrically from the handle;

a first set of multiple power cable pulleys, each having a power cable journal;

a first draw cable pulley (i) rotatably mounted on the first bow limb, (ii) having a draw cable journal, and (iii) having mounted thereon one of the power cable pulleys of the first set, a first pulley assembly comprising the first draw cable pulley and the power cable pulley mounted thereon;

a second pulley assembly rotatably mounted on the second bow limb and including at least one draw cable journal;

a draw cable (i) received in the draw cable journal of the first draw cable pulley, and (ii) received in the draw cable journal of the second pulley assembly; and a first power cable (i) arranged to be received in the power cable journal of the power cable pulley of the first set that is mounted on the first draw cable pulley and (ii) coupled to the second bow limb, wherein:

the first draw cable pulley is arranged so as to have interchangeably mounted thereon any one of the first set of multiple power cable pulleys;

the first draw cable pulley, the power cable pulley mounted on the first draw cable pulley, the second pulley assembly, the draw cable, and the power cable are arranged so that pulling the draw cable to draw the bow results in: (i) rotation of the first draw cable pulley and the second pulley assembly, (ii) the draw cable being let out from the first draw cable pulley and the second pulley assembly, and (iii) the first power cable being taken up by the power cable pulley mounted on the first draw cable pulley;

at least one power cable pulley of the first set is arranged so as to result in substantially negligible let-off of draw force of the bow; and at least one other power cable pulley of the first set is arranged so as to result in substantial let-off of the draw force of the bow at a corresponding draw length.

2. The bow of claim 1 further comprising:

a second set of multiple power cable pulleys, each having a power cable journal and each corresponding to one of the power cable pulleys of the first set;

a second draw cable pulley (i) rotatably mounted on the second bow limb, (ii) having a draw cable journal, and (iii) having mounted thereon the power cable pulley of the second set corresponding to the power cable pulley of the first set that is mounted on the first draw cable pulley, the second pulley assembly on the second bow limb comprising the second draw cable pulley and the power cable pulley mounted thereon; and a second power cable (i) arranged to be received in the power cable journal of the power cable pulley of the second set that is mounted on the second draw cable pulley and (ii) coupled to the first bow limb, wherein:

the second draw cable pulley is arranged so as to have interchangeably mounted thereon any one of the second set of multiple power cable pulleys;

the first and second draw cable pulleys, the mounted power cable pulleys of the first and second sets, the draw cable, and the first and second power cables are arranged so that pulling the draw cable to draw the bow results in: (i) rotation of the first and second draw cable pulleys, (ii) the draw cable being let out from the first and second draw cable pulleys, (iii) the first power cable being taken up by the power cable pulley mounted on the first draw cable pulley; and (iv) the second power cable being taken up by the power cable pulley mounted on the second draw cable pulley;

at least one power cable pulley of the first set and its corresponding power cable pulley of the second set are arranged so as to result in substantially negligible let-off of draw force of the bow; and at least one other power cable pulley of the first set and its corresponding power cable pulley of the second set are arranged so as to result in substantial let-off of the draw force of the bow at a corresponding draw length.

3. The bow of claim 2 further comprising:

a first power cable let-out pulley that (i) is mounted on the first draw cable pulley, (ii) has a power cable let-out journal, (iii) is arranged to receive the second power cable in the power cable let-out journal, and (iv) is arranged to let-out the second power cable when the bow is drawn; and a second power cable let-out pulley that (i) is mounted on the second draw cable pulley, (ii) has a power cable let-out journal, (iii) is arranged to receive the first power cable in the power cable let-out journal, and (iv) is arranged to let-out the first power cable when the bow is drawn.

4. The bow of claim 2 wherein (i) the first power cable is secured to the second bow limb and (ii) the second power cable is secured to the first bow limb.

5. The bow of claim 2 wherein the first and second draw cable pulleys are substantial mirror images of one another, and the first and second sets of power cable pulleys are substantial mirror images of one another.

6. The bow of claim 1 wherein at least one of the power cable pulleys of each set is arranged so as to enable the bow to exhibit multiple differing draw lengths depending on the arrangement of the mounted power cable pulley.

7. The bow of claim 6 wherein at least one of the power cable pulleys of each set is arranged so that mounting that power cable pulley in one of multiple differing positions on the corresponding draw cable pulley results in multiple corresponding differing draw lengths exhibited by the bow.

8. The bow of claim 6 wherein each set includes multiple differing power cable pulleys that are each arranged, when mounted on the draw cable pulley, so as to result in corresponding differing draw lengths exhibited by the bow.

9. The bow of claim 1 wherein each draw cable pulley or each power cable pulley is arranged so as to enable interchangeable mounting of each of the power cable pulleys while the draw cables and power cable are attached to the pulley assembly.

10. The bow of claim 9 wherein each draw cable pulley includes a power cable journal arranged to receive the corresponding power cable and, with the bow at brace, to prevent that power cable from being received in the power cable journal of the corresponding power cable pulley.

11. The bow of claim 1 wherein each set of power cable pulleys is arranged so that the draw force of the bow over a draw distance prior to let-off using the power cable pulleys that result in substantial let-off is substantially the same as the draw force over that same draw distance using the power cable pulleys that result in substantially negligible let-off.

12. The bow of claim 1 wherein:

the draw cable pulley lets out a first end of the draw cable when the bow is drawn;

the first pulley assembly further comprises a draw cable let-out pulley having a draw cable let-out journal, the draw cable let-out pulley being (i) mounted on the first draw cable pulley, (ii) arranged to receive the draw cable in the draw cable let-out journal, and (iii) arranged to let out a second end of the draw cable when the bow is drawn;

the second pulley assembly comprises an idler wheel; and the draw cable passes around the idler wheel.

13. A pulley assembly for a compound archery bow, the pulley assembly comprising:

a first set of multiple power cable pulleys, each having a power cable journal; and a first draw cable pulley (i) having a draw cable journal, (ii) having mounted thereon one of the power cable pulleys of the first set, and (iii) arranged to be rotatably mounted on a first bow limb of an archery bow, to receive the draw cable in the draw cable journal, and to let out the draw cable when the bow is drawn;

wherein:

the first draw cable pulley is arranged so as to have interchangeably mounted thereon any one of the first set of multiple power cable pulleys;

each power cable pulley of the first set is arranged to receive a first power cable in the power cable journal and to take up the first power cable when the bow is drawn;

at least one power cable pulley of the first set is arranged so as to result in substantially negligible let-off of draw force of the bow; and at least one other power cable pulley of the first set is arranged so as to result in substantial let-off of the draw force of the bow at a corresponding draw length.

14. The apparatus of claim 13 further comprising a second pulley assembly, the second pulley assembly comprising:

a second set of multiple power cable pulleys, each having a power cable journal and each corresponding to one of the power cable pulleys of the first set; and a second draw cable pulley (i) having a draw cable journal, (ii) having mounted thereon the power cable pulley of the second set corresponding to the power cable pulley of the first set that is mounted on the first draw cable pulley, and (iii) arranged to be rotatably mounted on a second bow limb of the bow, to receive the draw cable in the draw cable journal, and to let out the draw cable when the bow is drawn, wherein:

the second draw cable pulley is arranged to so as to have interchangeably mounted thereon any one of the second set of multiple power cable pulleys;

each power cable pulley of the second set is arranged to receive a second power cable in the power cable journal and to take up the second power cable when the bow is drawn;

at least one power cable pulley of the second set is arranged so as to result in substantially negligible let-off of draw force of the bow; and at least one other power cable pulley of the second set is arranged so as to result in substantial let-off of the draw force of the bow at the same corresponding draw length as the corresponding power cable pulley of the first set.

15. The apparatus of claim 14 wherein the pulley assemblies are substantial mirror images of one another.

16. The pulley assembly of claim 13 wherein at least one of the power cable pulleys is arranged so as to enable the bow to exhibit multiple differing draw lengths depending on the arrangement of the mounted power cable pulley.

17. The pulley assembly of claim 16 wherein at least one of the power cable pulleys is arranged so that mounting that power cable pulley in one of multiple differing positions on the draw cable pulley results in multiple corresponding differing draw lengths exhibited by the bow.

18. The pulley assembly of claim 16 wherein the first set includes multiple differing power cable pulleys that are each arranged, when mounted on the draw cable pulley, so as to result in corresponding differing draw lengths exhibited by the bow.

19. The pulley assembly of claim 13 wherein the draw cable pulley or the power cable pulleys are arranged so as to enable interchangeable mounting of each of the power cable pulleys while the draw cable and power cable are attached to the pulley assembly.

20. The pulley assembly of claim 19 wherein the draw cable pulley includes a power cable journal arranged to receive the power cable and, with the bow at brace, to prevent the power cable from being received in the power cable journal of the power cable pulley.

21. The pulley assembly of claim 13 wherein the power cable pulleys are arranged so that the draw force of the bow over a draw distance prior to let-off using the power cable pulley that results in substantial let-off is substantially the same as the draw force over that same draw distance using the power cable pulley that results in substantially negligible let-off.

22. The pulley assembly of claim 13 wherein the draw cable pulley lets out a first end of the draw cable when the bow is drawn, the pulley assembly further comprising a draw cable let-out pulley, the draw cable let-out pulley being (i) mounted on the draw cable pulley, (ii) arranged to receive the draw cable in a draw cable let-out journal, and (iii) arranged to let out a second end of the draw cable when the bow is drawn, the draw cable passing around an idler wheel on a second bow limb of the bow.

23. The pulley assembly of claim 13 further comprising a power cable let-out pulley that (i) is mounted on the draw cable pulley, (ii) has a power cable let-out journal, (iii) is arranged to receive a second power cable in the power cable let-out journal, and (iv) is arranged to let-out the second power cable when the bow is drawn.

* * * * *